US005238242A

United States Patent [19]

Edwards

[11] Patent Number: 5,238,242

[45] Date of Patent: Aug. 24, 1993

[54] MODULAR BOWLING ALLEY PIT ASSEMBLY

[75] Inventor: Garland U. Edwards, Chesterfield, Va.

[73] Assignee: AMF Bowling, Inc., Mechanicsville, Va.

[21] Appl. No.: 559,084

[22] Filed: Jul. 30, 1990

[51] Int. Cl.[5] ..... A63D 5/00

[52] U.S. Cl. ..... 273/37; 273/43 R; 198/842

[58] Field of Search ..... 273/37, 42 R, 43 R, 273/43 D, 43 E, 46, 47, 48, 49, 54 R; 198/837, 840, 841, 842

[56] References Cited

U.S. PATENT DOCUMENTS

| | | | |
|---|---|---|---|
| 1,758,280 | 5/1930 | Evans | 198/842 |
| 2,765,172 | 10/1956 | Zuercher et al. . | |
| 2,767,984 | 10/1956 | Zuercher . | |
| 3,248,109 | 4/1966 | Blewitt, Jr. et al. . | |
| 3,297,322 | 1/1967 | Ernst et al. | 273/49 |
| 3,479,029 | 11/1969 | Zuercher et al. . | |
| 3,526,401 | 9/1970 | Zuercher . | |
| 3,807,732 | 4/1974 | Congelli . | |
| 3,981,391 | 9/1976 | Phillips et al. | 198/840 |
| 4,790,428 | 12/1988 | Ramsey | 198/840 |

*Primary Examiner*—V. Millin
*Assistant Examiner*—William M. Pierce
*Attorney, Agent, or Firm*—Bacon & Thomas

[57] ABSTRACT

A modular bowling alley pit assembly includes a drawer-like structure which is adapted for positioning within the pit area at one end of a bowling alley. The modular assembly also includes a pair of rollers and an endless belt which passes around the rollers for moving fallen pins rearwardly from the alley and ball deflecting means for moving a ball toward a ball return mechanism. A forward one of said rollers also defines an uninterrupted surface about the roller. The assembly also includes a pair of angularly disposed tracking rollers for engaging the endless belt and the entire assembly is readily removed from the pit area for replacement or repair.

9 Claims, 5 Drawing Sheets

MODULAR BOWLING ALLEY PIT ASSEMBLY

BACKGROUND OF THE INVENTION

This invention relates to a modular bowling alley pit assembly and, more particularly, to the combination of a bowling pin elevator, ball return and modular pit assembly for transferring bowling pins and balls to the pin elevator and ball return.

Bowling pins and balls typically arrive in a pit area under considerable force and must be separated with the pins being fed to a pin elevating mechanism and thence to a pin distributor and spotter while the bowling balls are delivered to a ball return. For this reason, it is customary to provide a conveyor or travelling pit-wide apron as disclosed in the U.S. Pat. No. 3,526,401 of Zuercher. In such systems, a pit assembly includes a pit-wide belt which travels on a pair of parallel rollers. These rollers are transverse of the pit and mounted in a lower position thereof so that the top portion of the belt moves rearwardly and carries the fallen pins rearwardly to the pin elevating mechanism. This mechanism which is at the back of the pit carries or lifts the pins upwardly to a pin distribution system for delivery to a pin spotter.

The apparatus normally disposed in a bowling alley pit is designed to withstand considerable forces. Bowling balls and pins strike the pit assembly directly or bounce off the side walls or kick backs and fall onto the moving conveyor. The balls and pins frequently strike the front roller in the assembly, i.e., the roller which is immediately behind the pin deck. Because of the forces of the striking pins and balls, the front roller must withstand such forces and at the same time maintain proper alignment to avoid undue wear on the pit wide belt. To accomplish this, such rollers comprise a relatively complex and expensive split roller that provides limited lateral movement between the split portions. This lateral movement compensates for movement in the roller and tracking of the belt. Nevertheless, such rollers and belt assemblies require servicing, repair, realignment and at times replacement.

In most of the modern bowling centers, the alleys are disposed in a side by side arrangement with each pair of alleys separated by a ball return mechanism such as the one disclosed in my copending patent application now U.S. Pat. No. 5,076,582, entitled "Bowling Ball Lifting Apparatus" which issued on Dec. 31, 1991 and assigned to the same assignee, i.e., AMF Bowling, Inc. Such centers also incorporate pin elevating mechanisms at the rear of the pit assembly as well as a pin distributor system above the pit and an accompanying pin spotter above the pin deck. Consequently, there is very little room for making adjustments or repairs to the pit assembly. As a result, a pair of alleys may be taken out of service for a considerable time because of problems in the pit assembly area.

It has now been found that a modular pit assembly and combination of a modular pit assembly, pin elevator and ball return according to the present invention can overcome many of the problems associated with the frequency and length of time for repairs to a pit assembly. Such assemblies are also of less complex construction, provide for tracking adjustments from a remote area and incorporate a more durable front roller. The novel combination also includes a hingedly mounted pin elevating mechanism which further facilitates repairs to the pit assembly.

SUMMARY OF THE INVENTION

In essence, a modular pit assembly according to the present invention transfers bowling pins and balls to a pin elevator and ball return. The pit assembly includes a tray having a base member with a forward and rear portion and a pair of laterally-spaced walls. This tray is designed and adapted for positioning in the pit area at one end of a bowling alley with its forward portion adjacent to the pin deck of the alley. The tray is also designed so that its rear portion is adjacent to a pin elevating mechanism which feeds a conventional pin spotter. The modular pit assembly also includes a pair of rotatable rollers mounted on the tray between the laterally spaced walls, drive means which may include a motor and means operatively connecting the motor to one of the rollers for rotating the roller. In a preferred embodiment of the invention, a motor is independent of the pit assembly but operatively connected thereto by a belt and sprocket assembly. The modular pit assembly also includes an endless belt or carpet which passes over and around the rollers for rotation therewith. The rollers and belt are constructed and arranged so that the top surface of the belt is generally parallel to the surface of the alley and so that the top surface moves in a direction away from the pin deck and toward the pin elevating mechanism. Thus, the moving belt moves fallen pins rearwardly of the pin deck and toward the pin elevating mechanism. The pit assembly also includes ball deflecting means for directing or guiding a ball laterally across the belt and into the ball return. The modular assembly also includes a pair of angularly disposed tracking means or rollers which are adjustably mounted on the forward portion of the tray. The tracking rollers are angularly disposed from horizontal and, in a preferred embodiment of the invention, extend downwardly and outwardly from the laterally spaced walls. In this preferred embodiment, an outer end of the rollers extend below a bottom portion of the endless belt and rollers slightly behind the front roller. The tracking rollers also engage the lower portion of the endless belt and are constructed and arranged to be adjusted upwardly or downwardly to align the endless belt for proper tracking.

The invention also contemplates a novel hinge mounted vertically disposed pin elevator assembly which includes a frame and pin elevator wheel fixed to or mounted on the frame. In essence, this hinge mounted assembly forms a door-like structure which is closed during bowling. Fastening means and roller means are provided for positioning, fixing and supporting the pin elevator wheel in the closed position. However, by releasing the fastening means, latch or bolt, the entire pin elevator assembly can be swung back on the hinges while supported by the hinges and the roller means or caster, like the opening of a door. This opening then provides access to the pit assembly and facilitates removal of the modular assembly from the pit area or replacement with a new modular pit assembly.

BRIEF DESCRIPTION OF THE DRAWINGS

The invention will now be described in connection with the accompanying drawings, wherein like reference numbers have been used to designate like parts.

DETAILED DESCRIPTION OF A PREFERRED EMBODIMENT OF THE INVENTION

Figure 1:
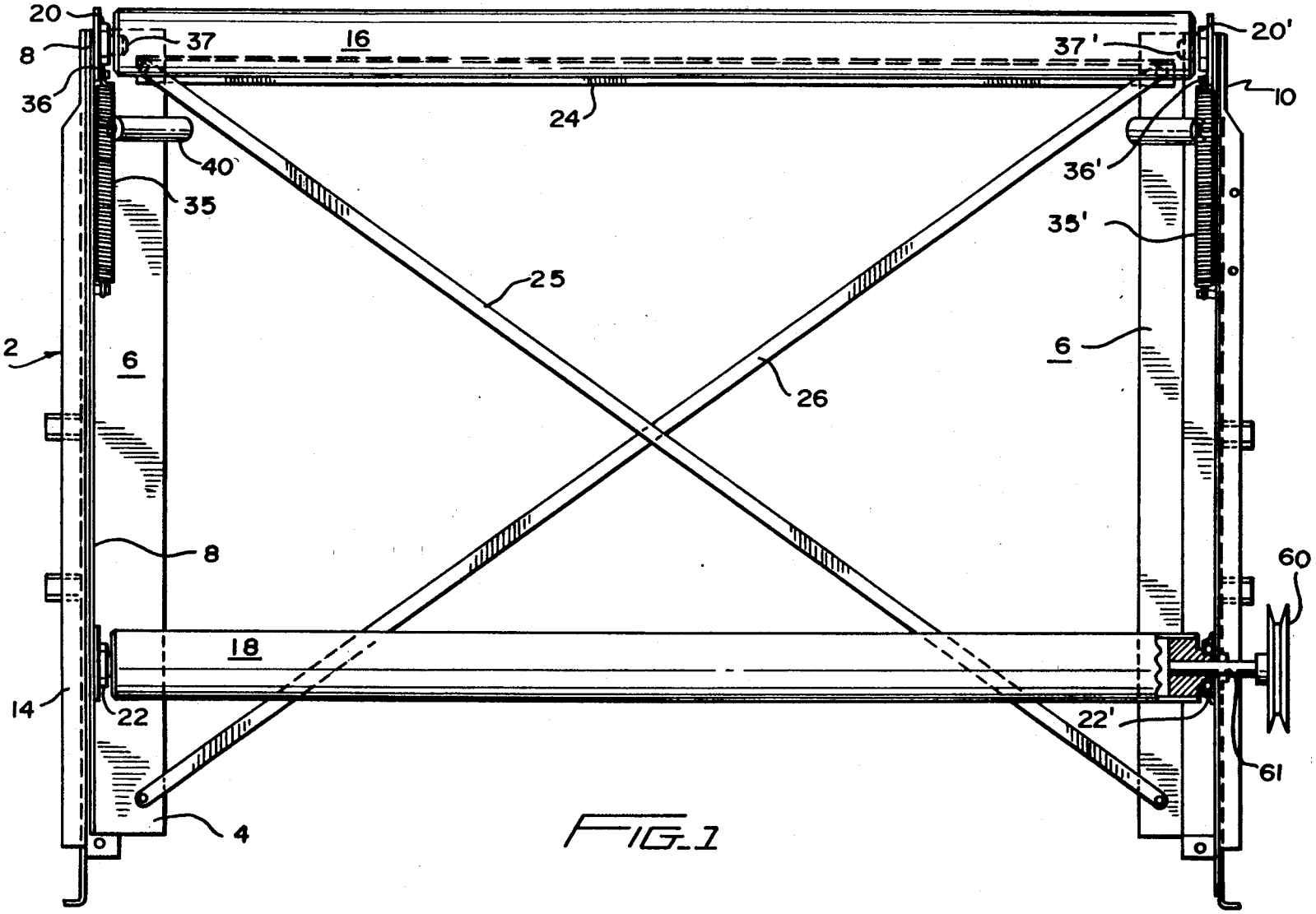
FIG. 1 is a top or plan view of a modular pit assembly according to a preferred embodiment of the invention.
Figure 2:
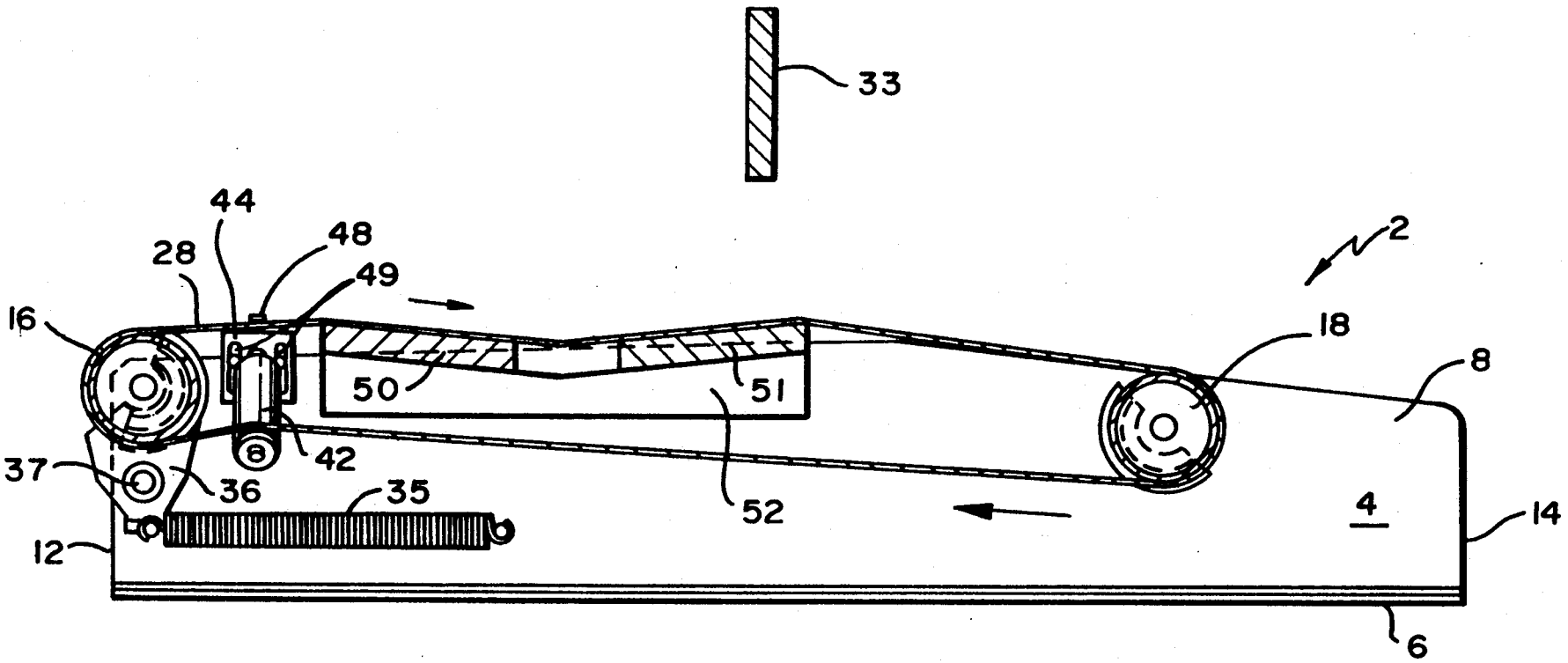
FIG. 2 is a cross-sectional view of the pit assembly shown in FIG. 1 and taken along the line 2—2 thereof.

A modular bowling alley pit assembly 2 (see FIGS. 1, 2 and 5) according to the present invention is disposed at the rear of a conventional bowling alley adjacent to the pin deck and between a pair of side walls or kick backs 3 which cause flying pins and balls to fall into the pit. One of such kick backs normally include an opening or door 5 in a lower portion thereof for receiving bowling balls and allowing the balls to be returned to a bowler in a manner which is described in my aforementioned copending application which is incorporated herein in its entirety by reference. An alternative ball return mechanism is disclosed in Zuercher et al., U.S. Pat. No. 2,765,172, which is also incorporated herein in its entirety by reference. The pit assembly is also generally disposed in front of and immediately adjacent a pin elevating mechanism or assembly 7 which is adapted to receive pins from the rear of the pit assembly and lift those pins upwardly to a pin distributor and spotter (not shown).

Figure 8:
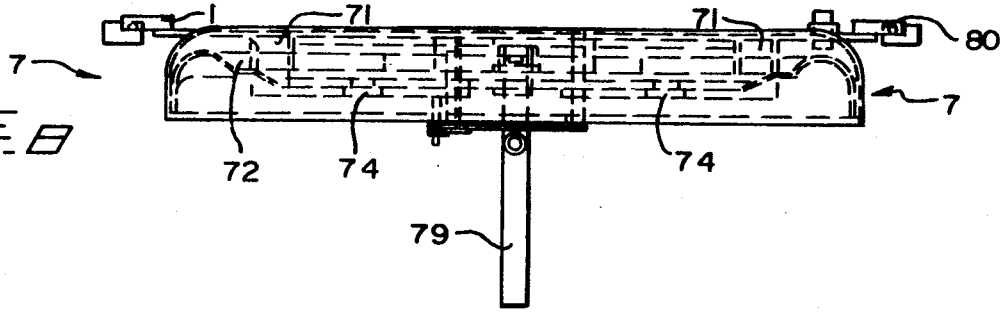
FIG. 8 is a top view of the pin elevator assembly shown in FIG. 7.
Figure 7:
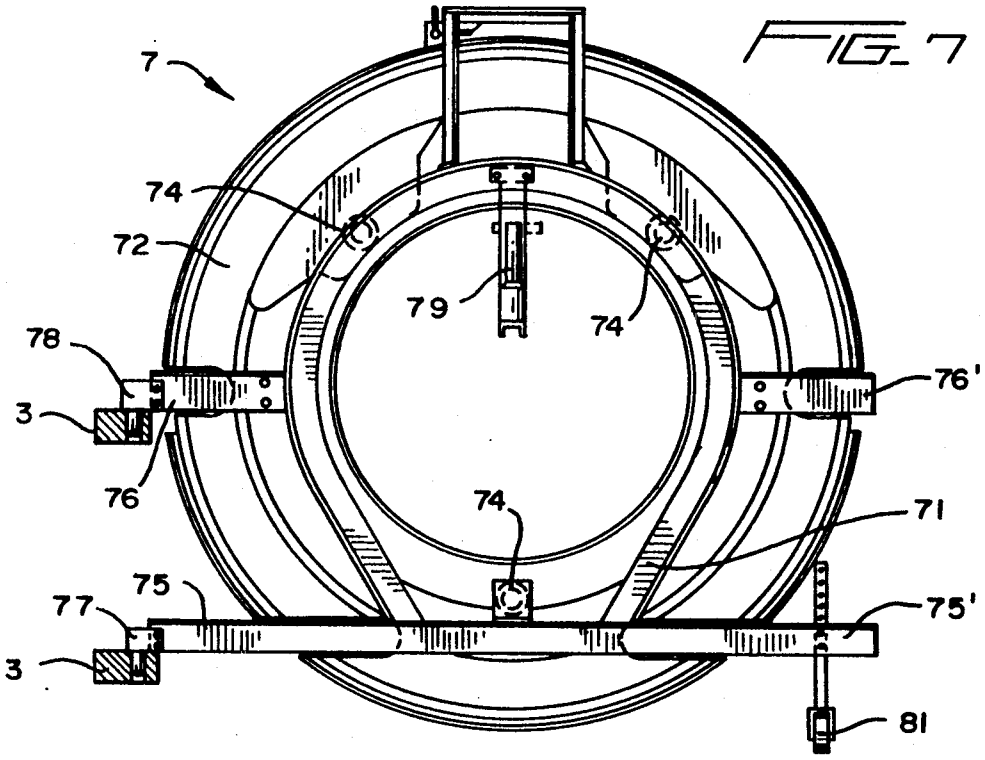
FIG. 7 is a rear view of a pin elevator assembly according to one embodiment of the invention.
Figure 9:
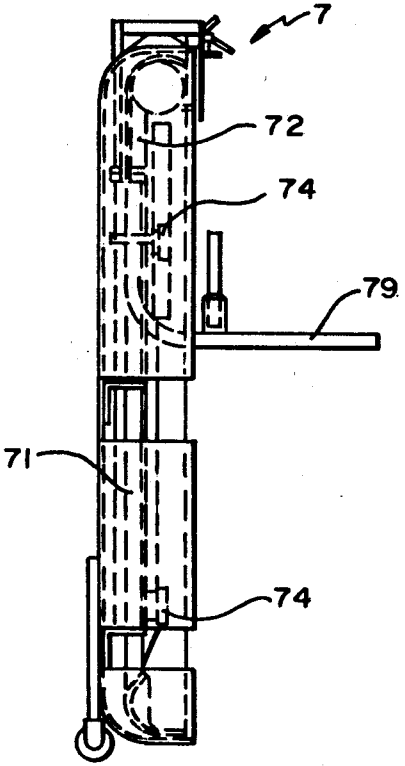
FIG. 9 is a side view of the pin elevator assembly shown in FIGS. 7 and 8.

The modular pit assembly 2 includes a tray 4 or drawer-like structure having a base member or portion 6 and a pair of laterally spaced walls 8,10. The tray 4 also includes a forward portion 12 and rear portion 14 and is constructed and arranged for positioning in the pit area at one end of a bowling alley. The tray 4 is also constructed and arranged so that its forward portion can be disposed immediately rearwardly of the pin deck of an alley (not shown) and the rearward portion will be immediately forward of a pin elevating mechanism or assembly which is illustrated in FIGS. 7 through 9.

The modular assembly 2 also includes a pair of laterally disposed rotatable parallel rollers 16,18 which are disposed in suitable bearing assemblies 20,20', 22,22' disposed on side walls 8,10. A lateral brace member 24 and cross-braces 25,26 provided added rigidity or structural support for the tray 4.

An endless pitwide belt or carpet 28 passes over and around rollers 16 and 18 for rotation therewith. The belt 28 moves in the direction of the arrow so that the upper or top surface of belt 28 moves the pins rearwardly away from the pin deck and toward a pin elevating mechanism. This top surface of the belt is generally parallel to the surface of the alley but somewhat below that surface.

The modular pit assembly also operates in conjunction with a ball deflecting means 33 which is not generally a part of the modular pit assembly 2. The ball deflecting means 33 prevents a bowling ball from moving rearwardly thereof but allows fallen pins to pass freely thereunder. Consequently, a bowling ball will be moved laterally toward the ball elevating mechanism in a customary manner.

The modular pit assembly 2 also includes spring tension means 35,35' which act in conjunction with pivotal members 36,36' for maintaining the endless belt 28 under tension. These pivotal members 36,36' are essentially crank arms mounted on shafts 37,37' and exert pressure against bearing assemblies 20,20'.

Figure 3:
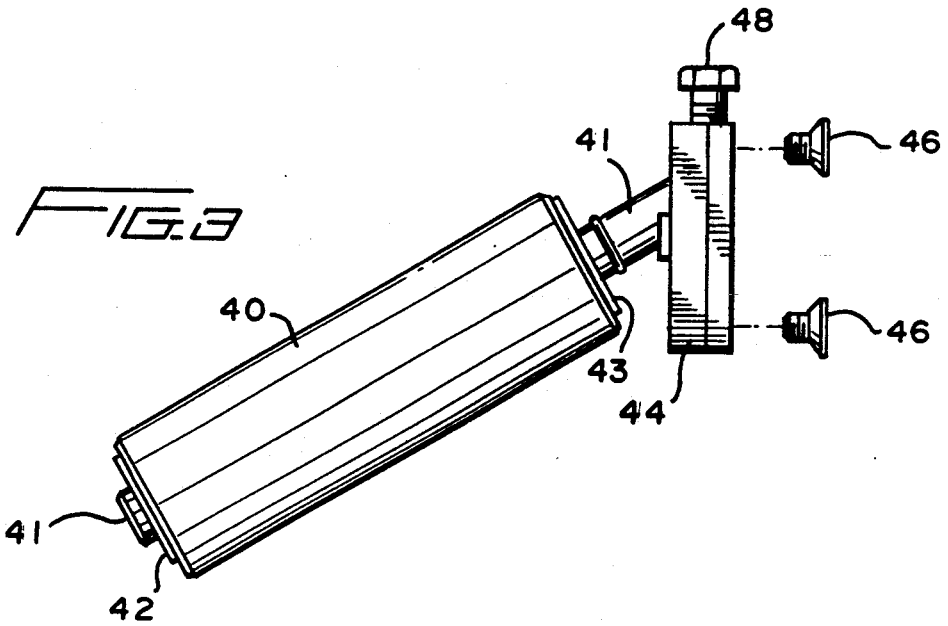
FIG. 3 is a side-elevational view of a tracking roller assembly as used in the preferred embodiment of the invention.
Figure 4:
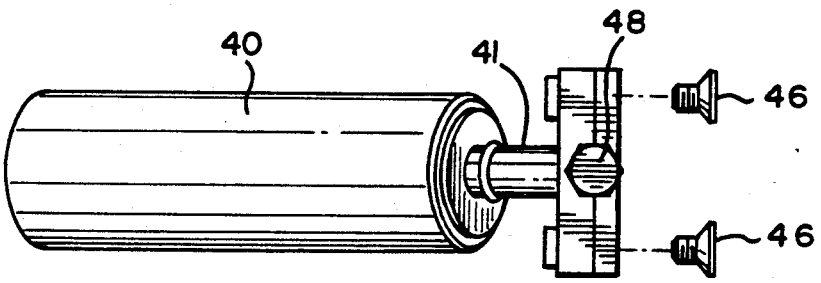
FIG. 4 is a top or plan view of the roller assembly shown in FIG. 3.

A pair of angularly disposed tracking rollers 40,42 are adjustably mounted on side walls 8,10. The rollers 40–42 preferably extend downwardly and inwardly to form an angle of about 45° off of vertical as illustrated in FIGS. 3 and 4. As shown in FIGS. 3 and 4, the tracking rollers comprise a downwardly extending shaft 41 having a roller 40 rotatably mounted thereon and held in place by end cap assemblies 42,43. The shaft 41 is fixed to a mounting bracket 44 and held to the side wall by bolts 46. An adjusting means or screw 48 is constructed and arranged to move the roller 42 upwardly or downwardly along the vertical axis for aligning the endless belt 28 and providing proper tracking thereof. A pair of vertical channels 49 are constructed and arranged in member 44 so that the roller assembly 42 can be moved by means of screw 48. In practice, a tool such as a socket and ratchet with an extension can be used to make appropriate adjustments in the tracking rollers without removing the modular assembly 2 from the pit.

The modular assembly 2 also includes a pair of laterally extending longitudinally-spaced bounce boards 50,51 which are carried on a pair of bounce board angle mounts 52,53 by means of rubber shock mounts 54. The bounce boards 50,51 are spaced slightly and slightly offset angularly to thereby form a trough which directs the bowling ball toward one side of the pit. Thus, with the longitudinal movement of the belt, the trough tends to cradle the bowling ball and it is thus moved laterally toward a ball lift mechanism (not shown). The trough is slightly angled in order to direct the ball toward one side of the pit and serves to initiate movement of the ball for its return to a bowler by directing the ball toward and through opening or door 5 for engagement by the mechanism disclosed in my aforementioned co-pending application.

Figure 5:
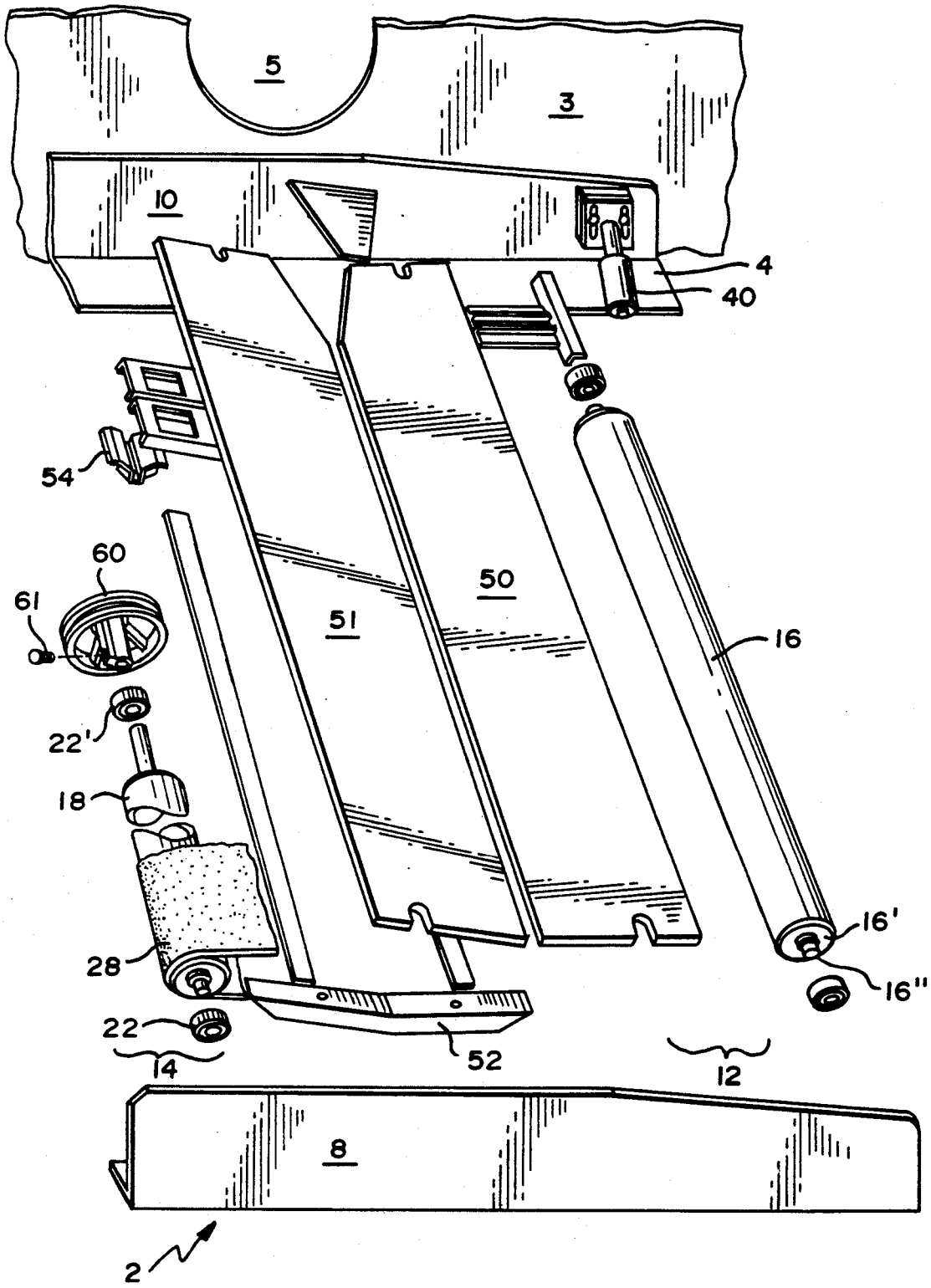
FIG. 5 is a partially exploded, somewhat schematic perspective view of a bounce board assembly within the modular pit assembly according to the present invention.

The bounce board arrangement is illustrated more clearly with respect to an exploded somewhat schematic perspective view in FIG. 5. As illustrated therein, a suitable drive means such as pulley 60 is connected by means of a hex drive 61 to rotatable roller 18 and belt 28 by means of a motor and belt (not shown).

One of the major advantages of the modular assembly is that it can be readily removed from the pit area by swinging the pin elevating mechanism to one side as will be explained hereinafter and then sliding the modular assembly out of the pit for easy access and repair. Thus, for more extensive repairs, a pit assembly may be readily removed and a replacement slid into place so that the down time of an alley is minimized.

Figure 6:
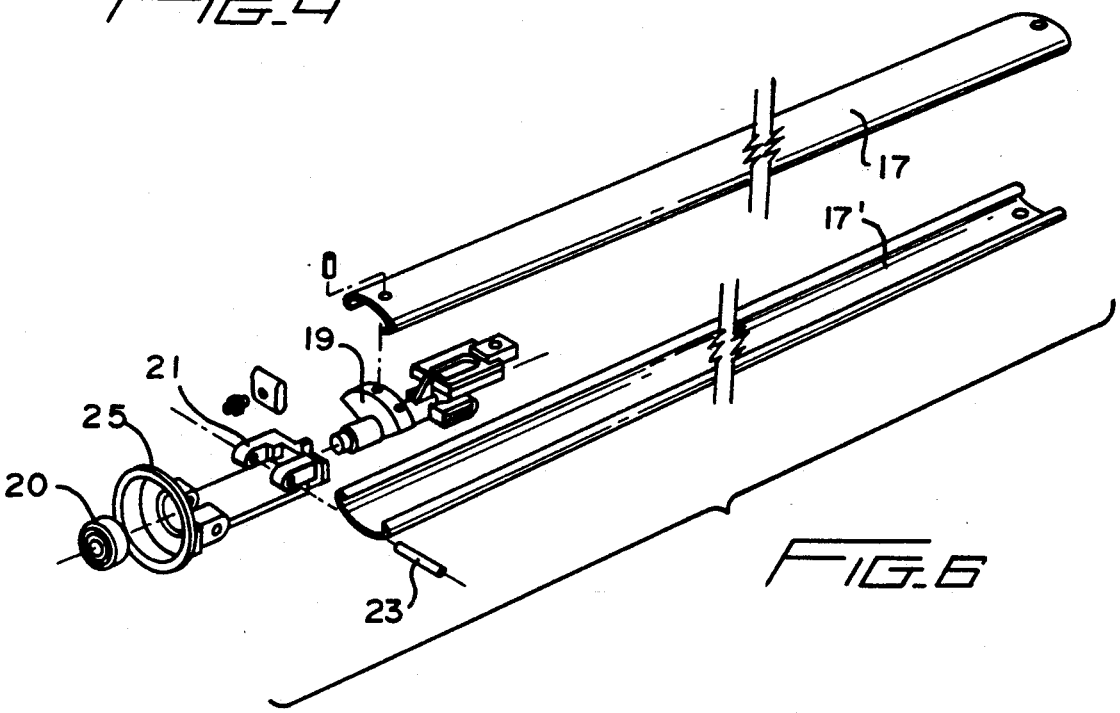
FIG. 6 is a perspective view illustrating a prior art front roller assembly.

The front roller 16 in accordance with a preferred embodiment of the invention comprises a round tube or elongated right circular cylinder with a hub 16' and shaft 16" at each end thereof. This so-called solid shaft 16 is more desirable and causes less down time due to repairs than the split shafts of the prior art. For comparison, the prior art front rollers illustrated in FIG. 6 were made up of two half round sheet metal parts 17,17' which are bolted to a casting shaft 19 that is hinged by link 21 to pin 23 and casting 25. Casting 25 is then mounted on bearing 20 which is disposed in the pit side or kickback 3.

The invention also contemplates a novel hinge mounted vertically disposed pin elevator assembly 7 which includes a horseshoe shaped frame 71 and a pin elevator wheel 72. A bowling pin 73 is, for example, shown in an upper portion of wheel 72 in FIG. 9. The pin wheel itself is supported by three plastic rollers 74, two of which are stationary while the lower roller may be adjustable. The horseshoe frame 71 also carries two pairs of laterally or horizontally disposed support members 75,75' and 76,76', members 75,75' forming the lower structural support for the front while members 76,76' are disposed near the vertical center of frame 7. The members 75,76 are hingedly mounted to the kickback 3 by means of hinge assemblies 77,78. A distributor mounting bracket 79 may also be carried by the horseshoe frame 71. Latch means 80 interacts with member 76' to clamp the elevator assembly in a closed position, i.e., perpendicular to a bowling alley during a game of bowling. A roller means or caster 81 is also mounted on structural member 75' and supports the assembly 7 when the latch 80 is opened and the assembly 7 is swung open for maintenance, removal or replacement of the modular assembly 2.

Thus, the hinged assembly 7 acts as a large door-like structure which can be swung open through an arc of about 90° or more so that the entire drawer-like structure, i.e., modular assembly 2, can be readily serviced or removed. By contrast, prior art pin elevating assemblies were supported by a ring assembly, supported by four steel rollers and bolted to the pit sides or kickbacks. Consequently, such assemblies required removal in order to gain access to the pit assembly.

Aside from the horseshoe frame or hinge mounting, the pin elevating mechanism is of conventional construction as will be understood by those who are skilled in the art. For example, a typical elevating assembly is disclosed in Zuercher, U.S. Pat. No. 2,767,984, which is incorporated herein by reference.

While the invention has been described in connection with a preferred embodiment, it should be understood that changes and modifications can be made without departing from the scope of the appended claims.

What is claimed is:

1. A modular pit assembly for transferring bowling pins and balls to a pin elevator and ball return comprising a tray having a base member, a forward and rear portion and a pair of laterally spaced walls to thereby form a drawer-like structure, a pair of rotatable rollers mounted on said tray between said walls with one of said rollers disposed in said forward portion of said tray and the other of said rollers disposed in said rear portion of said tray, a motor and means operatively connecting said motor to one of said rollers for rotation thereof, an endless belt passing over and around said rollers for rotation therewith with a top surface of said belt moving in a direction away from the pin deck and toward the pin elevating mechanism so that fallen pins will be carried rearwardly toward the pin elevating mechanism, ball deflecting means including a pair of bounce boards for guiding a ball laterally across said belt away from the pin elevating mechanism and toward a ball return mechanism, and a pair of roller tracking means adjustably mounted in said forward portion of said tray and angularly disposed with respect to and engaging said endless belt so that the tracking of said endless belt may be regulated by adjusting the position of one of said roller tracking means and means for removably positioning said tray including said pair of rotatable rollers, said endless belt, said ball deflecting means and said pair of roller tracking means in a pit area as a unitary assembly.

2. A modular pit assembly according to claim 1 in which said pair of laterally spaced walls extend upwardly and in which each of said rollers is essentially parallel with the plane of the bowling alley but perpendicular to the longitudinal direction of the alley.

3. A modular pit assembly according to claim 2 which includes structural support means connected to and supporting said pair of walls to reduce any lateral displacement thereof.

4. A modular pit assembly according to claim 3 in which the forward one of said rotatable rollers defines an elongated right circular cylinder with an uninterrupted surface for contacting said endless belt.

5. A modular pit assembly according to claim 4 in which said tracking rollers are adjustably mounted on said laterally spaced upwardly extending walls and adapted to be moved up or down to a selected position.

6. A modular pit assembly according to claim 5 which includes means for adjusting the tracking rollers from a position above said tray.

7. A modular pit assembly according to claim 4 in which said ball deflecting means is disposed between said rollers and between an upper and lower portion of said endless belt.

8. A modular pit assembly according to claim 5 in which said roller tracking means includes an angularly displaced roller portion that is disposed at an angle of about 45° from horizontal and in which the lower portion thereof extends downwardly below a lower portion of said endless belt.

9. A modular pit assembly according to claim 8 in which said roller tracking means is disposed rearwardly of said front roller but in close association therewith.

* * * * *